US009675844B2

(12) United States Patent
Stroud

(10) Patent No.: US 9,675,844 B2
(45) Date of Patent: Jun. 13, 2017

(54) DIVING FIN APPARATUS, SYSTEMS AND METHODS OF USE

(71) Applicant: Daniel W. Stroud, Ojai, CA (US)

(72) Inventor: Daniel W. Stroud, Ojai, CA (US)

( * ) Notice: Subject to any disclaimer, the term of this patent is extended or adjusted under 35 U.S.C. 154(b) by 0 days.

(21) Appl. No.: 15/142,643

(22) Filed: Apr. 29, 2016

(65) Prior Publication Data

US 2017/0007888 A1 Jan. 12, 2017

Related U.S. Application Data

(60) Provisional application No. 62/155,391, filed on Apr. 30, 2015.

(51) Int. Cl.
*A63B 31/12* (2006.01)
*A43B 5/08* (2006.01)

(52) U.S. Cl.
CPC ..... *A63B 31/12* (2013.01); *A43B 5/08* (2013.01)

(58) Field of Classification Search
CPC ..... A63B 2031/112
See application file for complete search history.

(56) References Cited

U.S. PATENT DOCUMENTS 8,678,870 B2 * 3/2014 Johnson ..... A63B 31/12 441/60
2010/0075554 A1 * 3/2010 Johnson ..... A63B 31/11 441/64

* cited by examiner

*Primary Examiner* — Edwin Swinehart
(74) *Attorney, Agent, or Firm* — Schmeiser, Olsen & Watts, LLP

(57) ABSTRACT

A diving fin system is provided. The fin system includes without limitation a collapsible, leg mounted diving fin. The fin system includes a first section mounted to lower leg and a second section and a third section that can collapse up to and around the lower leg. When collapsed, it can have a very low profile such that it looks like a slightly wider version of the calf area of the leg. It can be also be a three-piece deploying fin, wherein the first section is maintained coupled to the lower leg, the second section slides and rotates to couple to the top of a foot and the third section rotates away from the second section to form the fin blade for use in diving, such as scuba diving.

20 Claims, 4 Drawing Sheets

DIVING FIN APPARATUS, SYSTEMS AND METHODS OF USE

CROSS REFERENCE TO RELATED APPLICATION[S]

This application claims priority to U.S. Provisional patent application entitled "DIVING FIN APPARATUS, SYSTEMS AND METHODS OF USE," Ser. No. 62/155,391, filed Apr. 30, 2015, the disclosure of which is hereby incorporated entirely herein by reference.

BACKGROUND OF THE INVENTION

Technical Field

This invention relates generally to swim fin apparatuses, systems, and methods of use for same and, more particularly, to a collapsible, leg mounted diving fin.

State of the Art

Scuba Diving is an equipment intensive activity. If you are doing it for fun you can have as much as 100 lbs. of weight on your upper body. If you are scuba diving for the military, rescue or commercial reasons you can have much more weight on your body. The current diving fin designs mount over the end of the foot. It is extremely difficult to walk on land and through the surf with fins on your feet. One aspect of the problem is that a diver must have all their equipment on, then just before entering the water from the beach, boat or aircraft bend down with all that cumbersome gear on and put his fins over the ends of their feet. If you are going into the water from the beach you must walk into the surf backwards with your fins on or walk into the water waist or chest deep, then bend down into the surf to put on your fins. If you are a military or rescue diver you must jump into very difficult and dangerous water condition, then while in those conditions but on your fins. Getting out of the water can be more difficult. Exhausted from the dive and half way out of the surf or at the side of the boat while floating, you must crouch into a ball and remove your fins, thereby keeping track of them in your hands so as not to lose them.

Most divers also have a spear gun, fish or camera in their hands already. For commercial, military and rescue divers getting out of the water onto a ship in distress or through the surf onto a beach in a combat environment becomes a very dangerous and critical task. The diver must take his fins off and store them on his body before exiting the water. And never let go of the fins because they must have them to re-enter the water when the time comes. If they lose them they are not going anywhere. For all divers putting on and taking off the diving fin is a difficult cumbersome task.

With the fin mounted over the end of the foot, the diver is very restricted in the choices of boot or sock like booty they can wear. A heavy equipment activity performed in rough conditions a strong supportive boot with good traction is needed.

Current technologies therefore present a number of disadvantages including those described above. All current diving fins fit over the end of the foot, for example. They are typically rubber and plastic flexible fins that fit over the top of a diving booty onto the foot.

Therefore, it is readily apparent that there is a need for a diving fin that can be readily accessed and transported without having to be carried by hand, and which can be quickly and easily be deployed for use or stored as needed.

DISCLOSURE OF THE INVENTION

The invention disclosed herein includes without limitation apparatuses, systems and methods of using a collapsible, leg mounted scuba diving fin. In one embodiment, the fins can collapse up to and around the lower leg. When collapsed, it can have a very low profile such that it looks like a slightly wider version of the calf area of the leg. It can be also be a three-piece deploying fin.

In another embodiment, the fin can be deployed in the water by releasing a hold down strap from the knee, then lifting up to extend the fins sections and letting the fins swing down to the foot latching into position. Retracting the fin can then be achieved by pulling a release at the knee as well, and executing the deployment steps in reverse. With the heavy equipment associated with scuba diving, this type of fin can allow you to deploy and retract the fin without bending over. And you can never lose it.

In a further embodiment, with the fin collapsed up to and around the lower leg, the diver can walk freely as if nothing cumbersome was there. It can feel much like wearing shin guards or lightweight body armor. In one embodiment, the construction of the fin can be composite fiberglass material and aluminum. This is a very strong material used in boat building and military grade body armor. In fact, it could also provide substantial protection to the lower leg. This can be very useful for commercial, military and rescue divers. For all divers, they can put the fin on and forget it is there. Then use it when it is needed.

The diving fin can collapse up to and around the lower leg, thereby becoming an outer shell on the lower leg when closed such as when the fin is not in use. This can permit a user to walk through water with no restriction in movement, for example. Then just by pulling up on the fin sections and letting the fin swing down to the foot you are diving. As well, if you were to sky dive down to the water, there should be no negative aerodynamic effect from the collapsed, closed diving fin design disclosed or claimed herein.

An embodiment includes a collapsible diving fin system comprising: a first section configured to couple to a lower leg of a user; a second section slidingly and hingedly coupled to the first section; and third section hingedly coupled the second section, wherein the fin system is moveable between a collapsed position and a deployed position, wherein the collapsed position includes the first section, second section and third section stacked on top of each other on the lower leg of the user, and the deployed position includes the first section coupled to the lower leg of the user, the second section coupled to a foot of the user and the third section forming a fin blade and extending from a toe of the user.

Another embodiment includes a diving boot comprising: a boot portion; and a collapsible diving fin system integral with the boot portion, wherein the collapsible diving fin system comprises: a first section configured to couple to a lower leg of a user; a second section slidingly and hingedly coupled to the first section; and third section hingedly coupled the second section, wherein the fin system is moveable between a collapsed position and a deployed position, wherein the collapsed position includes the first section, second section and third section stacked on top of each other on the lower leg of the user, and the deployed position includes the first section coupled to the lower leg of the user, the second section coupled to a foot of the user and the third section forming a fin blade and extending from a toe of the user.

Yet another embodiment includes a method using a collapsible diving fin system, the method comprising: releasably coupling a first section of the collapsible diving fin system to a lower leg of the user, wherein the collapsible diving fin system further includes a second section and a third section in a collapsed position wherein the first section, second section and third section are stacked on top of each other on the lower leg of the user; moving a second section of the collapsible diving fin system from the collapsed position to a deployed position; and moving the third section of the collapsible diving fin system from the collapsed position to the deployed position in response to moving the second section from the collapsed position to the deployed position, wherein the deployed position includes the first section coupled to the lower leg of the user, the second section coupled to a foot of the user and the third section forming a fin blade and extending from a toe of the user.

No currently available fin mounts to the lower leg and/or collapses up to the leg, essentially becoming an outer shell on the lower leg when closed. There is nothing like it on the market.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As described above, the invention disclosed herein includes without limitation apparatuses, systems and methods of using a collapsible, leg mounted scuba diving fin. In one embodiment, the fins can collapse up to and around the lower leg. When collapsed, it can have a very low profile such that it looks like a slightly wider version of the calf area of the leg. It can be also be a three-piece deploying fin.

Figure 1:
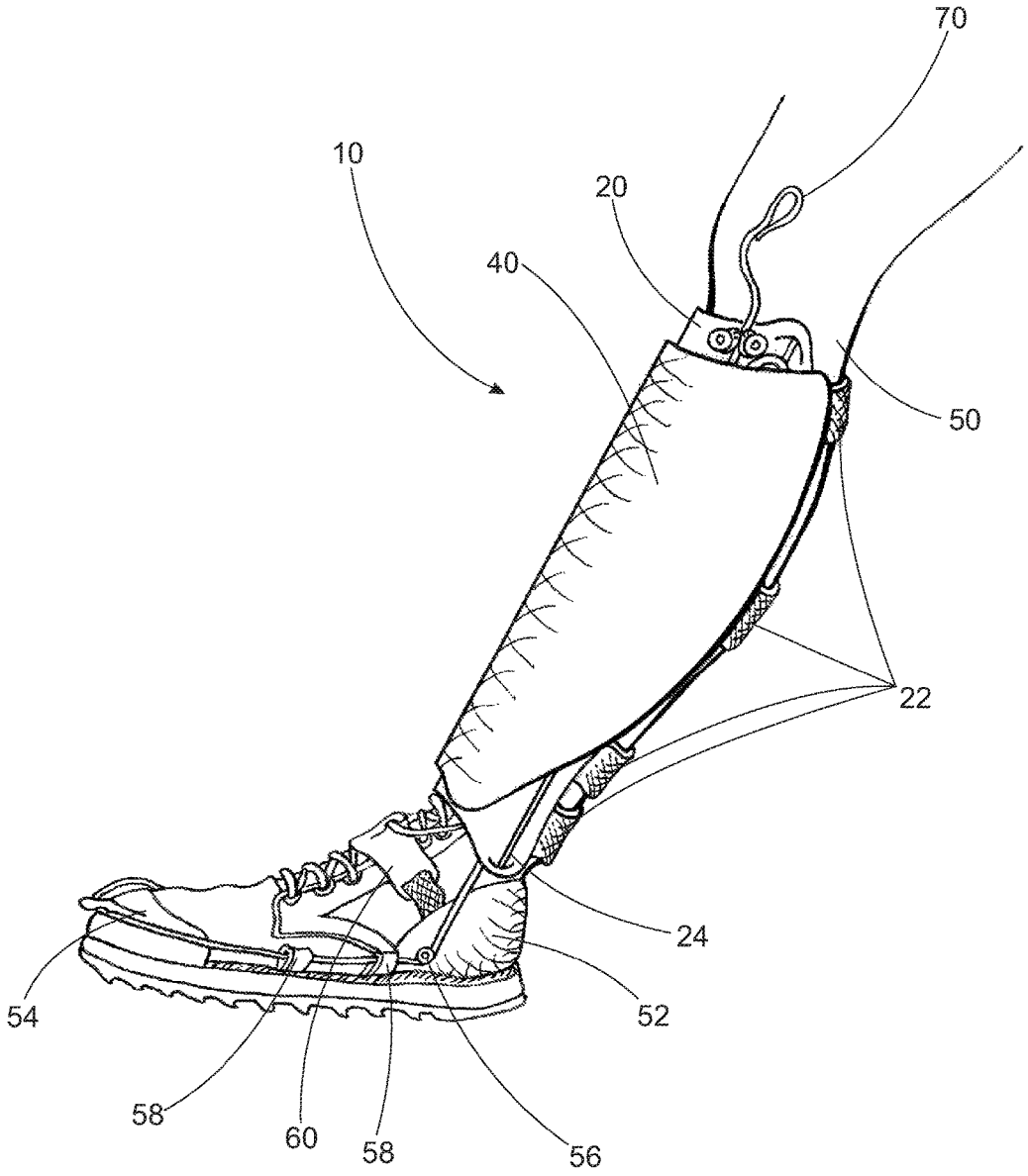
FIG. 1 is a side view of a collapsible diving fin system, in accordance with embodiments.
Figure 2:
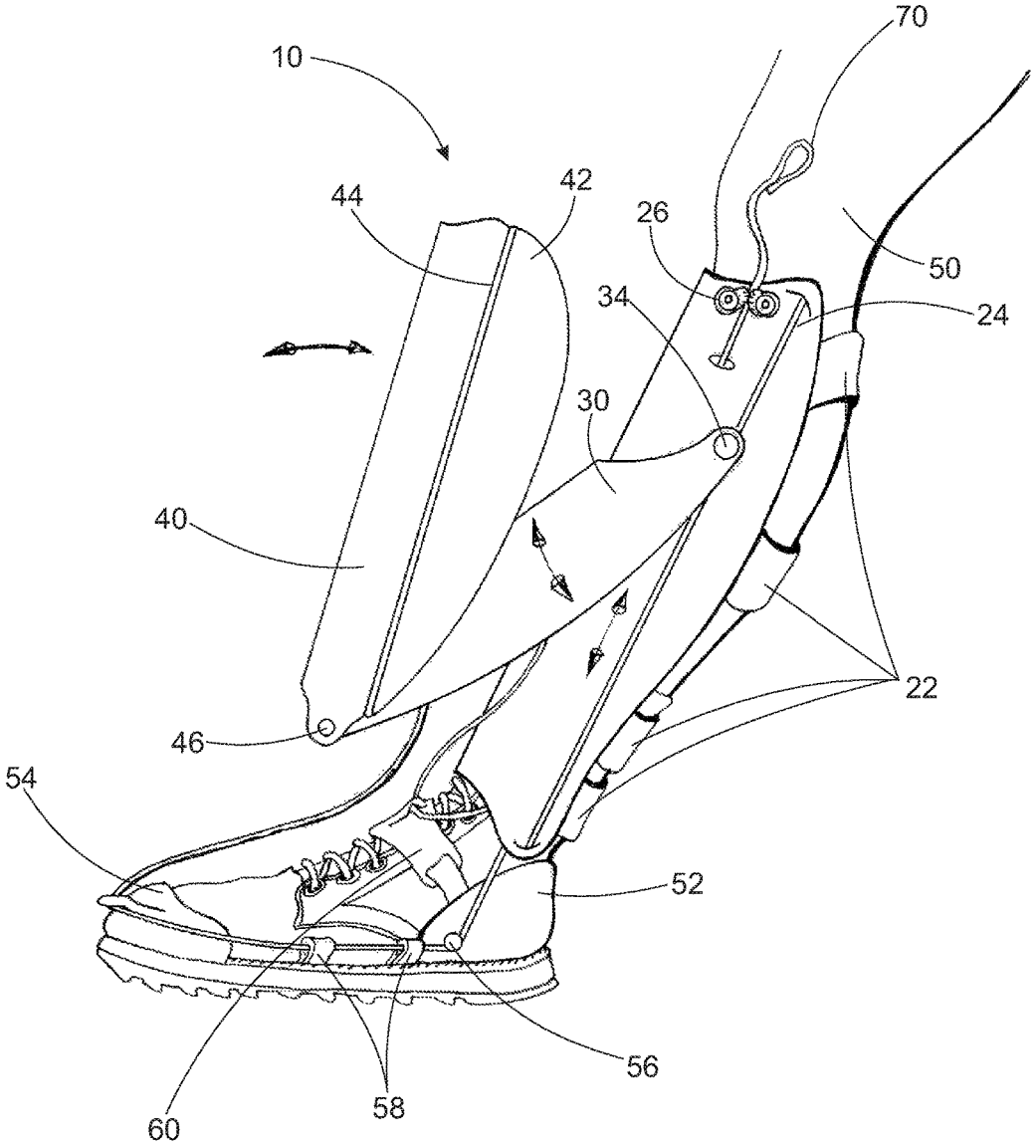
FIG. 2 is a side view of a collapsible diving fin system in partially extended or deployed position, in accordance with embodiments.
Figure 3:
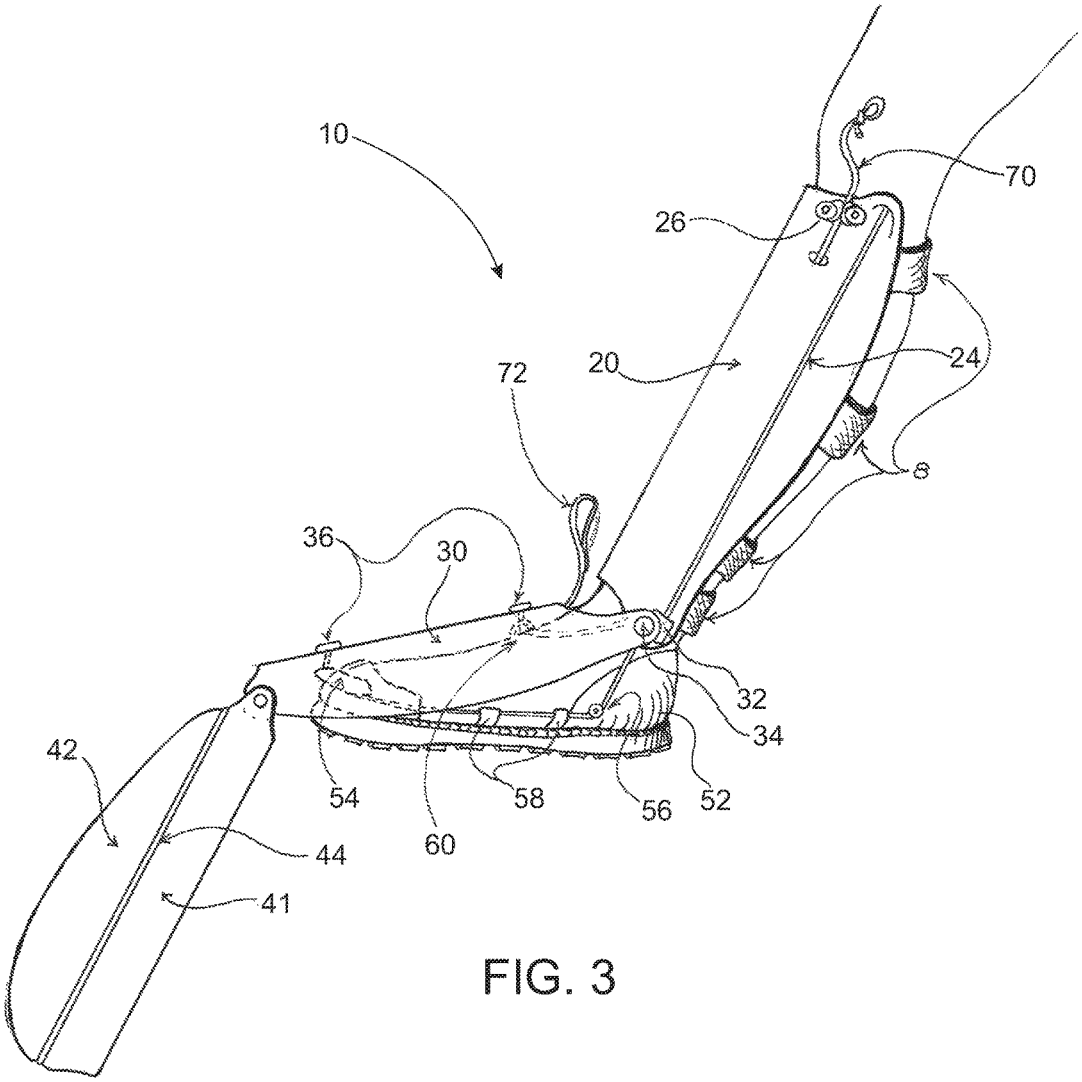
FIG. 3 is a side view of a collapsible diving fin system in an extended or deployed position, in accordance with embodiments.
Figure 4:
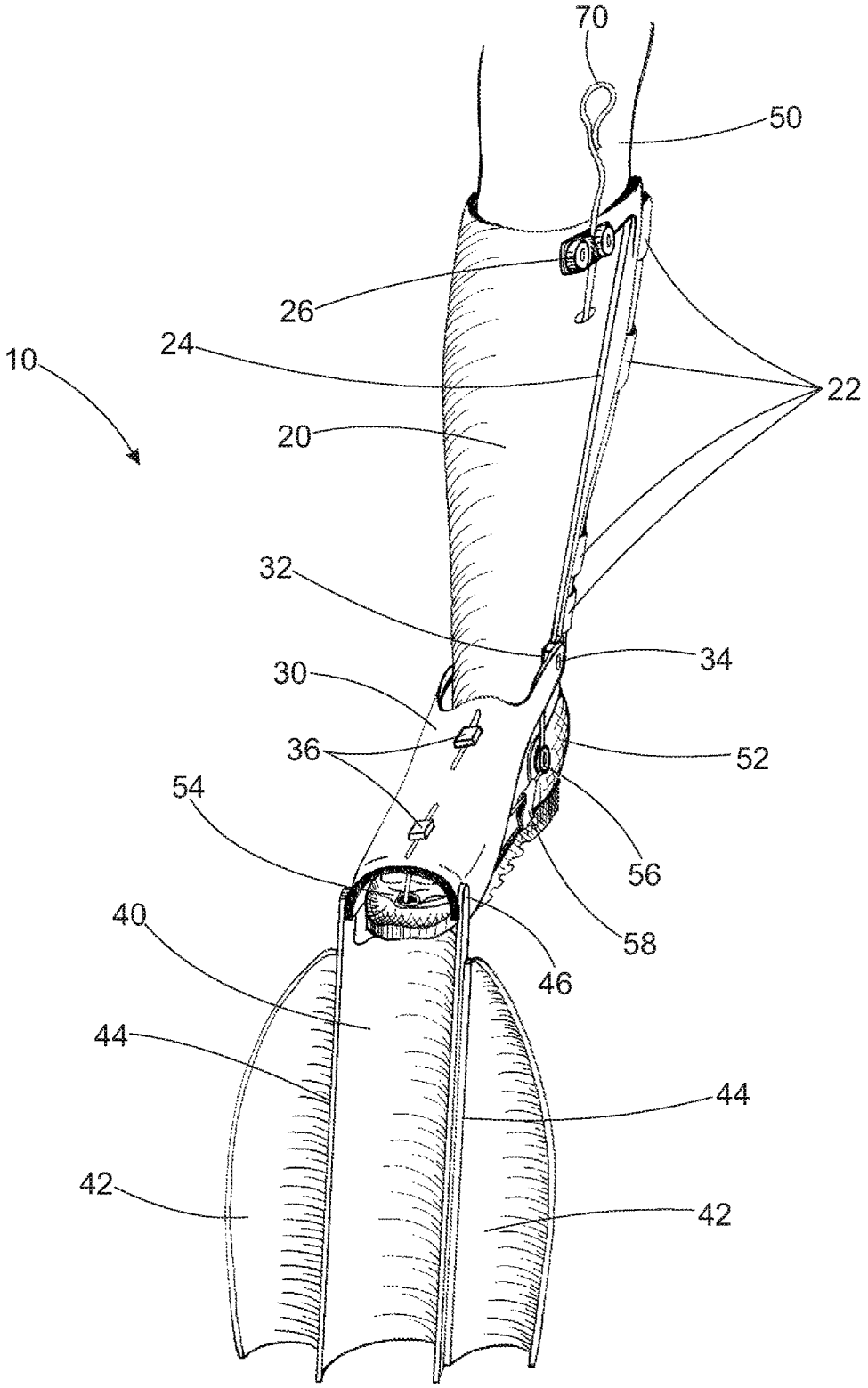
FIG. 4 is a perspective view of a collapsible diving fin system in an extended or deployed position, in accordance with embodiments.

Referring to the drawings, FIGS. 1-4 depict an embodiment of a collapsible diving fin system 10, in accordance with an embodiment of the present invention. The collapsible diving fin system 10 includes a first section 20, a second section 30 and a third section 40. The collapsible diving fin system 10 may be made from composite materials (such as, but not limited to fiberglass, carbon fiber, Kevlar) or high strength plastic. The fin system 10 mounts to a leg 50 below the knee with several webbing straps and buckles 40 that attach the first section 20 to the leg 50.

Second section 30 fits over the first section 20 when in the collapsed position with the second section 30 collapsed up to and around calf. When in the deployed position with the second section 30 deployed down to the foot by one or two lines 70 that pull it down and secure it to the top of the foot. The back end of the second section 30 at the ankle hinges on two sliders 32 the go up and down the calf mount piece sliding on two wire cables or tracks 24 mounted on both sides of the first section 20.

The third section 40 includes a fin blade center member 41. This third section 40 hinges on the end of the second section 30 with hinge 46. When the third section 40 is in the collapsed position with the third section 40 collapsed up to the lower leg 50 it covers and wraps around the lower calf. The first section 20 and the second section 30 are under this third section 40. The first, second and third sections 20, 30 and 40 respectively are three shell like shapes each matching the inside shape of the one outside of it. When in the collapsed position with the first, second and third sections 20, 30 and 40 collapsed up to the leg 50 all that is seen is a clean shape that looks like the calf of a person. The hinge point 46 on the center fin blade 41 also works as the pivoting point to allow the fin 10 to move and swing as the person using the fin 10 under water propels himself through the water.

The third section 40 may also include two side fin blade members 42. When in the collapsed position with the third section 40 collapsed up to the lower leg 50 these side fin blade members 42 form the side and back of the lower leg. They include longitudinal hinges 44 that extend longitudinally along the center fin blade 41. When the person uses the fin 10 to propel himself or herself through the water these two blades 42 swing and open and close on the respective kick stroke.

The slider wire or track 24 runs up and down the sides of the first section 20. This can also be a fixed track similar to what one would see in the small sailboat industry. The second section 30 slides up and down this wire or track 24 when the fin 10 is deployed and retracted.

A jam cleat 26 is coupled to the first section 20. This jam cleat 26 will hold tight (belay) the line 70 that when pulled will deploy the second section 30 down to the top of the foot and securing is tightly to the foot. The individual wearing the fin 10 will be able to deploy the fin 10 simply by reaching to the knee and pull the belay line 70 cleating it in the jam cleat 26. This will flip out the third section 40 that forms the fin blade and secure the second section 30 securely to the top of the foot.

The line 70 that will pull down the second section 30 to the foot and secure it there. This line 70 extends from the jam cleat 26 at the knee area under the first section 20 to a turning block 56 on the heel cup 52 of the dive boot 51. Then along the side of the boot 51 through fare leads 58 to a toe fare lead 54 at the top of the foot. The toe fare lead 54 is mounted to the toe of the boot 51. The toe fare lead 54 is the point that the deployment line 70 goes to and when the line is pulled tight the second section 30 is pulled down to this location securely.

The second section 20 includes stop sliders 36. The end of the deployment lines 70 attach to these sliders 36. The stop sliders 36 hold the line 70 and are in slots on the top of the second section 30. This allows for movement when the foot and leg move during the kick stroke.

A top foot fare lead 60 mounting point is part of fin system 10. This top foot fare lead 60 may be made of composite and stainless steel. The top foot fare lead 60 attaches to the top of the dive boot 51 and operates in conjunction with the toe fare lead 54 location holding the second section 30 securely to the top of the foot. This is a critical mounting location as it holds the fin 10 in place to the foot during the power kick stroke.

The fin system 10 may further include a return pull loop line 72. This is the webbing or line 72 that the user pulls up on to retract the fin 10, thereby collapsing it up to and around the lower leg 50. An alternate design has the fin retracting pull line 72 running up the face of the calf plate to a jam cleat at the knee. This would allow the user to potentially never have to bend over to deploy of retract their diving fins.

The first section 20 is mounted to a lower leg 50 on the front of the calf of a user. It can be made to fit tightly to the leg 50. The first section 20 can be held to the leg 50 with nylon-webbing straps 22 around the back of the leg, such as, but not limited to four straps 22 as depicted in FIGS. 1-4. The bottom part of the first section 20 in this embodiment can attach to the dive boot 52. The attachment to the boot 51 can provide additional stability.

The first section 20 has two track slider slots 24 that run from the top nearest the knee down each side to the bottom edge above the ankle. In each track slot 24 is a slider 32 that is attached to the top of the second section 30. The second section 30 is attached to the first section 20 at the two sliders 32 that slide up and down the track slots 24 in the first section 20. At the point where the second section 30 mates with the sliders 32 in the first section 20 there is a hinge point 34 to allow the second section 30 to swing up and down and slide up and down on the face of the first section 20. This combination of movements allows the second section 30 to slide up to and hinge down onto the first section 20. This position looks like two shells mated exactly on top of each other. The second section 30 when it slides down and swings down on top of the top of the foot it latches into a snap point 54 on the top of the actual foot or boot 52.

The third section 40 is coupled to the opposite end from the end of second section 30 that is operatively coupled to the first section 20 with a hinge 46. So when the fin 10 is completely deployed open the third section 40 swings from the end of the second section 30 closest to the toes of the actual foot. The third section 40 is made of three sections hinging the long way, from end of foot out to the end of the blade. They are three long curves sections similar to sections of a pipe. Then they are swung closed they resemble the shape of the lower leg calf. And when swung open the three sections look like the cupped open fins of a sea lion.

This situation allows the fin blade section to swing up onto the top of the foot section and then the foot section slides up to and swings over the leg section. This creates the closed position having three sections stacked over the front of the lower leg and using three matching curves shapes. When the fin blade section is swung down and the foot section swung up and slide down the face of the leg section this creates the open position. This looks like shells of a lobster covering the lower leg and top of the foot hinged at the ankle. The last fin blade section swinging cupped upward from the tip of the foot section, and the fin blade section with three hinged long scooped rounded sections hinged longitudinally opening and swinging closed as the diver swings his leg in a kicking motion.

In some embodiments, with the diving fin 10 mounted to the leg, the fin 10 can allow the foot to be completely free when the fin is collapsed against the leg. The fin 10 no longer fits over the end of a boot. The fin 10 can be mounted to the lower leg and latches to the top of the foot.

This design change can provide for the use of a more substantial supportive boot 51. With the heavy weight associated to scuba diving and the rough terrain traversed to get to the dive site a better boot is a very good additional improvement. This provides the ability to use the fin 10 with a strong supportive boot that is integrated into the diving fin. There may be sport and military versions of the boot. No longer will the diver have to walk over moss covered wet rocks in flexible unsupportive light construction sock-like neoprene booties to get to the water. Boots used with the fin system 10 will have a good all terrain sole and good ankle support. While existing, current dive booties come in small medium and large size, boots 51 of the embodiments will come in all the normal shoe sizes. These boots 51 are better fitting, very supportive, all-terrain, and completely submersible. For the sport diver this will be a great improvement. For the commercial, military and rescue diver this is essential.

The modular design allows for adjustments to size and length of the fin 10, first second and third sections 20, 30 and 40, and flexibility of fin blade. Providing a customizable fin 10 to fit the size and strength of the user. Custom sizing to best fit the diver.

In some embodiments, the fin 10 may be integrated with a strong supportive boot 51. In these embodiments, the fin system 10 may be coupled directly to the boot or formed as an integral component of the boot 51 thereby not needing straps 22 to attach the fin system 10 to the leg 50 of the user.

While several illustrative embodiments of the invention have been disclosed herein, still further variations and alternative embodiments will occur to those skilled in the art. The number or types of sections in a collapsible fin or fin system, for example, can vary according to the size, needs or desires of a particular user or group of users, as can the size and dimensions of the components. Similarly, Any suitable material can be used to fabricate one or more sections (or other components) of this retractable fin, including without limitation composite fiberglass material and aluminum. In addition, the embodiments described herein may be useful in other types of devices or systems, including without limitation those used for propulsion through liquids or gases.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A collapsible diving fin system comprising:

a first section configured to couple to a lower leg of a user;

a second section slidingly and hingedly coupled to the first section; and third section hingedly coupled the second section, wherein the fin system is moveable between a collapsed position and a deployed position, wherein the collapsed position includes the first section, second section and third section stacked on top of each other on the lower leg of the user, and the deployed position includes the first section coupled to the lower leg of the user, the second section coupled to a foot of the user and the third section forming a fin blade and extending from a toe of the user.

2. The system of claim 1, wherein the first section comprises two slider tracks that extend from a top portion of the first section to a bottom portion of the first section.

3. The system of claim 2, wherein the second section comprises two sliders coupled to an end of the second section with a hinge point, wherein each slider operatively engages one slider track and wherein the second section slides along the slider track and rotates about the hinge point.

4. The system of claim 3, wherein the third section is operatively coupled to the second section with a hinge, wherein the hinge couples one end of the third section to an end of the second section opposite the end coupled to the slider.

5. The system of claim 4, wherein the hinge operates as a pivot point during use of the system to move the fin system in response to kicking motions for propelling the user through water.

6. The system of claim 1, wherein the third section comprises a fin blade center member and side fin blades coupled on each side of the fin blade center member by a longitudinal hinge.

7. The system of claim 6, wherein the side fin blades rotate with respect to the fin blade center member wherein the side fin blades collapse around a leg of the user when in the collapsed position and rotate away from the fin blade center member to form a fin blade when in the deployed position.

8. The system of claim 1, further comprising a belay line operatively coupled to the first section and the second section, wherein applying a pulling force on the belay line moves the second section from the collapsed position to the deployed position, and wherein the third section moves from the collapsed position to the deployed position in response to movement of the second section from the collapsed position to the deployed position.

9. The system of claim 8, further comprising a return pull loop line operatively coupled to the second section, wherein applying a pulling force on the return pull loop line moves the second section from the deployed position to the collapsed position, and wherein the third section moves from the deployed position to the collapsed position in response to movement of the second section from the deployed position to the collapsed position.

10. The system of claim 1, further comprising a plurality of straps coupled to the first section, wherein the plurality of straps are configured to couple the first section to the lower leg of the user.

11. A diving boot comprising:

a boot portion; and a collapsible diving fin system integral with the boot portion, wherein the collapsible diving fin system comprises:

a first section configured to couple to a lower leg of a user;

a second section slidingly and hingedly coupled to the first section; and third section hingedly coupled the second section, wherein the fin system is moveable between a collapsed position and a deployed position, wherein the collapsed position includes the first section, second section and third section stacked on top of each other on the lower leg of the user, and the deployed position includes the first section coupled to the lower leg of the user, the second section coupled to a foot of the user and the third section forming a fin blade and extending from a toe of the user.

12. The boot of claim 11, wherein the first section of the collapsible diving fin system comprises two slider tracks that extend from a top portion of the first section to a bottom portion of the first section.

13. The boot of claim 12, wherein the second section of the collapsible diving fin system comprises two sliders coupled to an end of the second section with a hinge point, wherein each slider operatively engages one slider track and wherein the second section slides along the slider track and rotates about the hinge point.

14. The boot of claim 13, wherein the third section of the collapsible diving fin system is operatively coupled to the second section with a hinge, wherein the hinge couples one end of the third section to an end of the second section opposite the end coupled to the slider.

15. The boot of claim 14, wherein the hinge operates as a pivot point during use of the system to move the fin system in response to kicking motions for propelling the user through water.

16. The boot of claim 11, wherein the third section comprises a fin blade center member and side fin blades coupled on each side of the fin blade center member by a longitudinal hinge.

17. The boot of claim 16, wherein the side fin blades rotate with respect to the fin blade center member wherein the side fin blades collapse around a leg of the user when in the collapsed position and rotate away from the fin blade center member to form a fin blade when in the deployed position.

18. The boot of claim 11, further comprising a belay line operatively coupled to the first section and the second section, wherein applying a pulling force on the belay line moves the second section from the collapsed position to the deployed position, and wherein the third section moves from the collapsed position to the deployed position in response to movement of the second section from the collapsed position to the deployed position.

19. The boot of claim 18, further comprising a return pull loop line operatively coupled to the second section, wherein applying a pulling force on the return pull loop line moves the second section from the deployed position to the collapsed position, and wherein the third section moves from the deployed position to the collapsed position in response to movement of the second section from the deployed position to the collapsed position.

20. A method using a collapsible diving fin system, the method comprising:

releasably coupling a first section of the collapsible diving fin system to a lower leg of the user, wherein the collapsible diving fin system further includes a second section and a third section in a collapsed position wherein the first section, second section and third section are stacked on top of each other on the lower leg of the user;

moving the second section of the collapsible diving fin system from the collapsed position to a deployed position; and moving the third section of the collapsible diving fin system from the collapsed position to the deployed position in response to moving the second section from the collapsed position to the deployed position, wherein the deployed position includes the first section coupled to the lower leg of the user, the second section coupled to a foot of the user and the third section forming a fin blade and extending from a toe of the user.

* * * * *